US005553666A

United States Patent [19]

Hartman

[11] Patent Number: 5,553,666

[45] Date of Patent: Sep. 10, 1996

[54] STANDOFF INSULATOR AND METHOD FOR WELL PUMP CABLE

[75] Inventor: Chris J. Hartman, Garden Grove, Calif.

[73] Assignee: Atlantic Richfield Company, Los Angeles, Calif.

[21] Appl. No.: 467,942

[22] Filed: Jun. 6, 1995

[51] Int. Cl.[6] ..... E21B 36/00

[52] U.S. Cl. ..... 166/60; 166/62; 166/65.1; 166/241.7

[58] Field of Search ..... 166/60–62, 57–59, 166/65.1, 241.7, 242.3, 248; 392/301–306

[56] References Cited

U.S. PATENT DOCUMENTS

| | | | |
|---|---|---|---|
| 1,383,777 | 7/1921 | Stephens | 166/62 X |
| 1,712,101 | 5/1929 | Yerkes | 166/62 |
| 1,864,960 | 6/1932 | Taylor | 166/62 X |
| 2,268,978 | 1/1942 | White | 166/60 X |
| 2,350,429 | 6/1944 | Troupe | 392/305 X |
| 2,561,249 | 7/1951 | Tomlinson | 166/60 X |
| 2,781,851 | 2/1957 | Smith | 166/60 |
| 3,045,099 | 7/1962 | Bowman et al. | 392/302 |
| 5,148,864 | 9/1992 | Willis et al. | 166/65.1 |

*Primary Examiner*—Roger J. Schoeppel
*Attorney, Agent, or Firm*—Michael E. Martin

[57] ABSTRACT

A standoff insulator and support for an elongated power cable disposed adjacent to a fluid conducting tubing string for a fluid production well utilizing an electric submersible pump connected to the tubing string. The pump power cable is held in a standoff, thermally insulated position from the tubing string by an elastomer insulator body having opposed concave surfaces engageable with the power cable and the tubing string and a flexible strap trained through a slot along one side of the insulator and through a channel on the opposite side of the insulator. The strap includes a buckle for receiving a distal end of the strap whereby the strap is tensioned and secured to clamp the insulator between the power cable and the tubing string using strap tensioning and crimping tools, respectively. Strap and insulator devices may be placed along the tubing string at predetermined intervals to support the power cable in a standoff position to minimize heat transfer from production fluid flowing through the tubing string to the power cable insulation and conductors. The insulator body is preferably formed of a flexible elastomer material such as nitrile rubber.

13 Claims, 3 Drawing Sheets

STANDOFF INSULATOR AND METHOD FOR WELL PUMP CABLE

FIELD OF THE INVENTION

The present invention pertains to a standoff-type insulator for supporting an electrical power cable adjacent to but spaced from a production tubing string connected to a submersible motor-driven pump for a fluid production well.

BACKGROUND

One widely used method of artificial lift in the production of hydrocarbon fluids, such as crude oil, is characterized by the provision of a submersible electric motor-driven multistage pump which is disposed in the well and submerged in the fluid entering the wellbore for pumping the fluid to the surface through an elongated tubing string connected to the pump. It is conventional practice in such artificial lift installations to extend the electrical power cable to the pump trained generally alongside the production tubing string and strapped directly to the tubing for support of the cable and to minimize entanglement of the cable with structural features of the well.

However, a disadvantage of such arrangements is realized particularly in instances where the fluid, such as crude oil, being pumped through the tubing string is relatively hot. The electrical power cable may suffer thermal degradation from sustained exposure to high temperatures as a result of heat transfer from the tubing string directly to the cable or through its protective sheath. Moreover, elevated operating temperatures of the cable may also reduce its efficiency of electrical power transmission.

Depending on the characteristics of the reservoir being pumped the temperature of the oil flowing through the production tubing string to the surface may be in the range of 150° F. to 350° F., for example. Moreover, the heat generated by the pump electric motor and by the pump itself may raise the temperature of the oil flowing through the tubing string substantially higher than ambient well temperature conditions. Accordingly, for the first two or three hundred feet of tubing string extending uphole from the pump itself, heat transferred from the oil in the tubing string to the power cable may be substantial. Thus, it is desirable to provide for minimizing heat transferred to the power cable from the production tubing string while at the same time providing effective support of the cable by the tubing string.

An important consideration in providing for support of the power cable for submersible pump-type well installations is the ease with which the cable can be secured to the tubing string as the tubing string is being made up and lowered into the well. The complex and hazardous activities involved in making up elongated well tubing strings, including work associated with installing a submersible pump, strongly favors simplifying and minimizing the effort of any task related to such installations. Accordingly, the present invention has been developed with these desiderata in mind and with a view to providing a unique insulated support for electrical power cable for submersible well pump installations which is easy to install and which may utilize a method of installation which minimizes the activity required in advantageously securing the power cable to the well tubing string.

SUMMARY OF THE INVENTION

The present invention provides a unique insulator and support device for an electrical power cable and the like associated with a well tubing string. In accordance with an important aspect of the invention a power cable insulator and support device is provided for supporting an electrical power cable of a submersible well pump by and along the production fluid tubing string connected to the pump in such a way as to minimize heat transfer to the power cable from the fluid flowing through the tubing string, to properly support the cable by the tubing string at spaced apart points therealong and to provide for an efficient method of installing the support device as the tubing string is being made up and lowered into the well.

In accordance with another important aspect of the invention a standoff-type thermal insulator is provided for supporting a power cable and the like on and adjacent to a fluid conducting tubing, which insulator is preferably formed of an elastomeric material which has good thermal and electrical insulating properties, which is easily deformable elastically to accommodate an installation procedure using a flexible band or strap for securing the cable to the tubing with the insulator disposed therebetween. The insulator is of unique configuration which includes an elongated slot for supporting the insulator on a support strap in such a way that the insulator and the support strap may be easily positioned between the power cable and the tubing string during makeup and lowering of the tubing string into a well.

The present invention still further provides a unique method of attaching a power cable or similar conductor structure to the exterior of a tubing with a standoff-type thermal insulator disposed between the tubing and the cable or conductor utilizing a flexible strap or band. The method is carried out in such a way that conventional strapping or banding equipment may be utilized to connect the strap in supportive relationship to the cable or conductor with the insulator disposed between the cable or conductor and the tubing.

Those skilled in the art will appreciate the above-mentioned features and advantages of the invention together with other superior aspects thereof upon reading the detailed description which follows in conjunction with the drawing.

DESCRIPTION OF PREFERRED EMBODIMENTS

Figure 1:
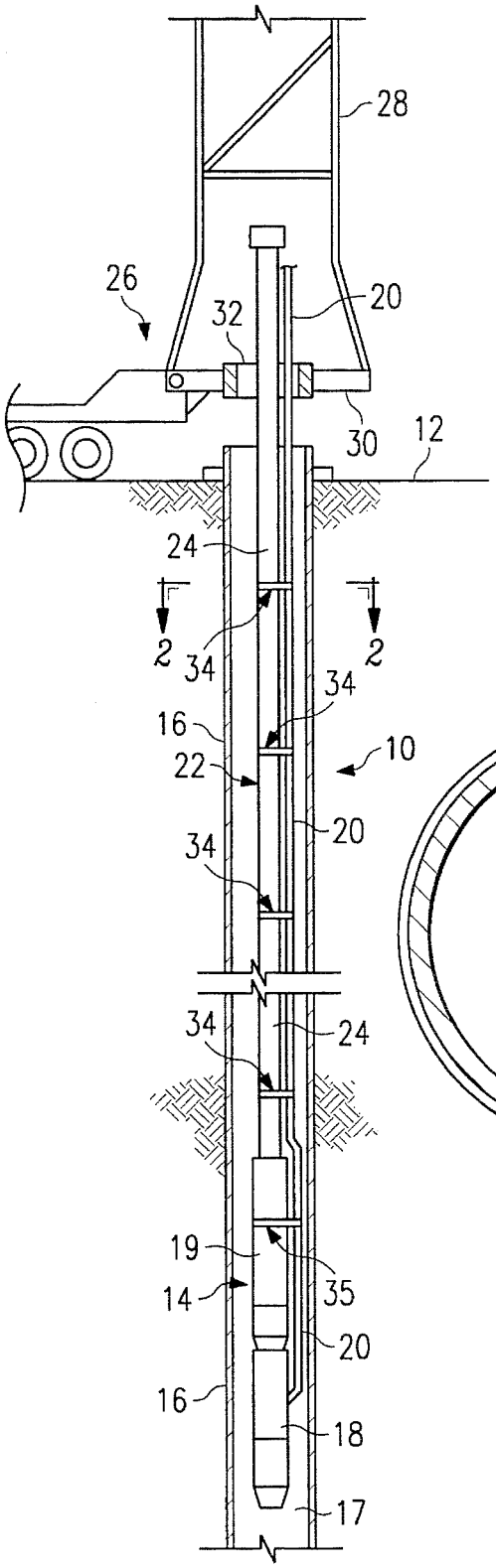
FIG. 1 is a view in somewhat schematic form of a fluid production well showing the installation of a submersible pump and associated power cable in accordance with the present invention.

In the description which follows like elements are marked throughout the specification and drawing with the same reference numerals, respectively. The drawing figures are not necessarily to scale in the interest of clarity and conciseness.

Referring to FIG. 1, there is shown a fluid production well, generally designated by the numeral 10, which is operable to produce fluids to the earth's surface 12 by artificial lift means comprising an electric motor-driven submersible pump unit 14. The pump unit 14 is shown disposed in the well 10, which preferably includes a tubular casing or liner 16 which is suitably perforated at a position, not shown, to allow fluids to flow into the wellbore 17.

The pump unit 14 includes a suitable electric motor 18 drivingly connected to a multistage centrifugal pump 19. The motor 18 is also connected to an elongated sheathed power cable 20 extending to a source of electric power at the surface 12. The pump 14 is also connected directly to an elongated tubing string 22 made up of one or more sections of steel fluid conducting tube 24 of conventional construction. The pump 14 may be of a conventional design, commercially available, and may range from as little as ten horsepower to several hundred horsepower in the output of motor 18. Accordingly, substantial heat is generated by the motor 18 and as a result of increasing the pressure of the fluid as it flows through the pump section 19.

The pump 14 is shown in FIG. 1 in the process of being lowered into the well 10 at the distal end of the tubing string 22 utilizing conventional tubing string installation equipment including a drilling or workover rig 26 having a suitable derrick 28 and a work platform or deck 30. A suitable bushing 32 is disposed in deck 30 and through which the tubing string 22 is lowered into the well. Conventional pipe handling equipment, associated with the rig 26 and not shown in the drawing may be utilized in making up the tubing string 22 and lowering the tubing string and the pump 14 into the well in a conventional manner.

As the tubing string 22 is being lowered into the well 10, it is advantageous to support the power cable 20 by the tubing string to minimize handling problems associated with the tubing string and the cable and to minimize the chance of snagging the cable on one or more structures in the well, not shown, which may interfere with movement of the tubing string and the cable into or out of the well. However, the ambient temperature of the fluid being pumped by the pump 14 may be in the range described above and, for at least the first two or three hundred feet of tubing string 22 directly above the pump 14, the temperature of the fluid may be substantially higher due to heat transferred to the fluid by the pump 14. Direct contact between the power cable 20, even if it includes a protective sheath, and the tubing 22 is undesirable in that the elevated temperature of the tubing resulting from the fluid flowing therethrough may rapidly degrade the cable and its insulation and otherwise result in power transmission losses due to the elevated temperature of the cable.

The present invention contemplates the provision of a unique insulator which is cooperable with a support strap or band for securing the cable 20 to the tubing string 22 but stood off from the tubing string in such a way that minimal heat is transferred to the cable from the fluid flowing through the tubing string. Accordingly, the cable 20 is supported at spaced apart points along the tubing string 22 by several unique support devices 34, as shown in FIG. 1. One or more support devices 35, similar to the devices 34, may also be used to hold the power cable 20 in a standoff position with respect to the pump 14, as also shown in FIG. 1.

Figure 2:
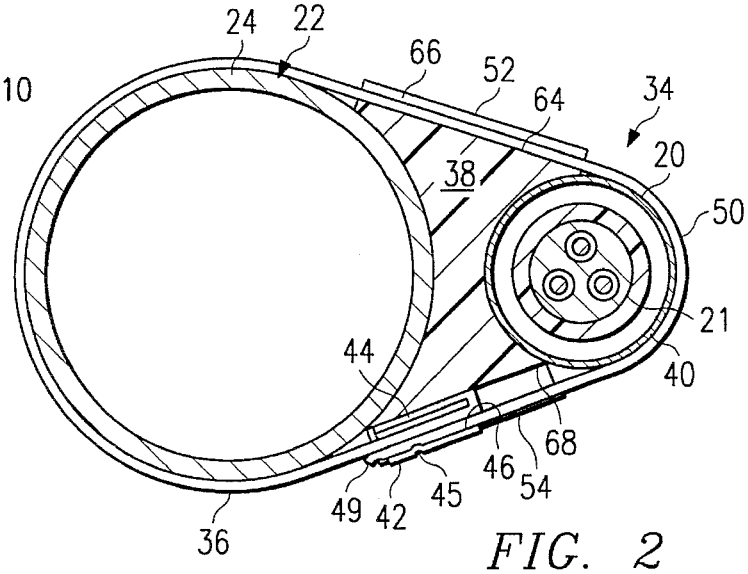
FIG. 2 is a section view taken generally from the line 2—2 of FIG. 1.

Referring to FIG. 2, each support device 34 is characterized by a flexible support strap or band 36 and a standoff insulator member 38 interposed between the tubing 24 and the power cable 20. As shown in FIG. 2, the power cable 20 may comprise an outer protective sheath 40 comprising an elongated tubular member, preferably formed of a corrugated metal or reinforced plastic to allow some flexing thereof. An insulated power cable 21 is shown disposed with the sheath 40 in a conventional manner.

Figure 3:
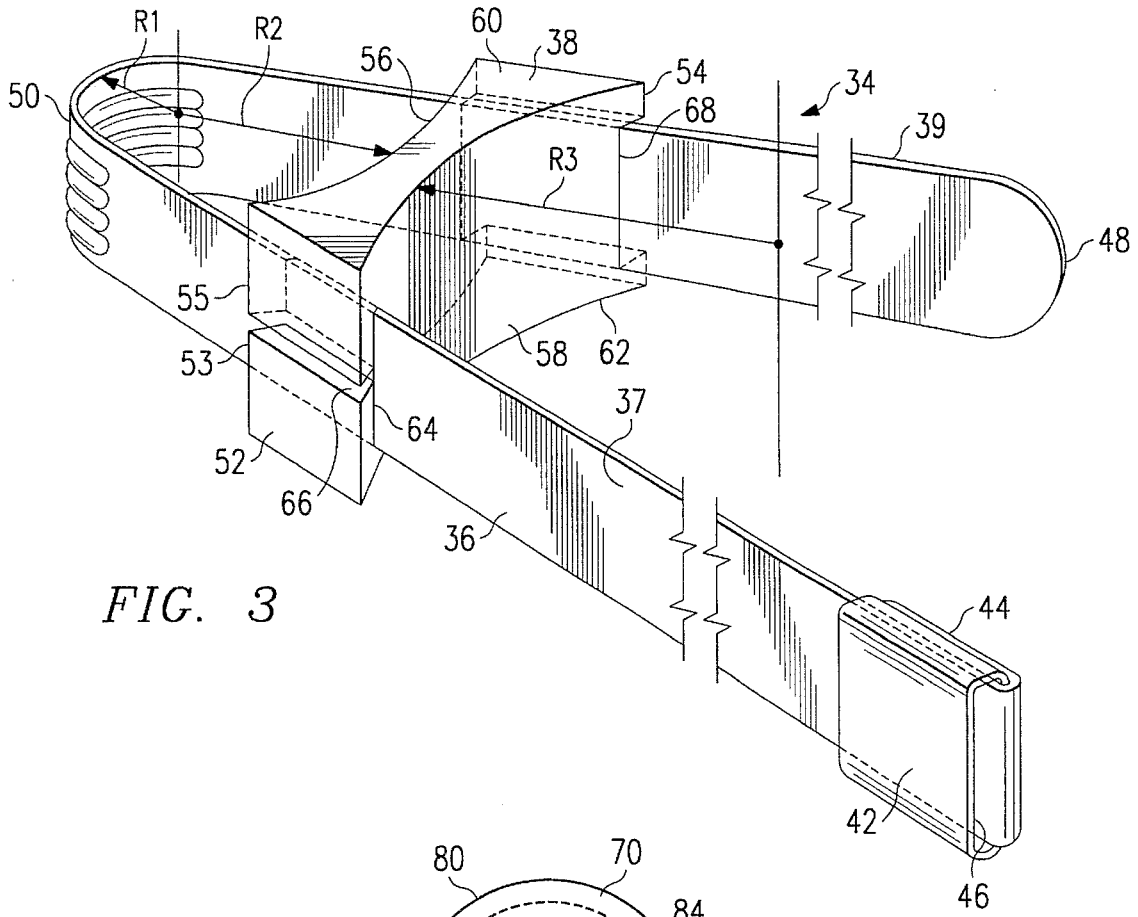
FIG. 3 is a perspective view of the insulator and support strap device of the present invention.

Referring now to FIGS. 2 and 3, the support device 34, including the strap 36 and the insulator 38, is shown in an assembled condition supporting the cable 20 in FIG. 2 and in a position in FIG. 3 prior to installation to secure the cable 20 to the tubing string 22. The strap 36 is preferably a conventional flexible metal band which may be elastically and plastically deformed into the secured position shown in FIG. 2 using conventional, commercially available strapping or banding equipment which will be described in some detail hereinbelow. The strap 36 includes a suitable crimping buckle 42 secured to one end 44 of the strap by folding the end over one side of the buckle. A slot 46 is formed in the buckle 42 for receipt of the opposite end 48 of the strap in a conventional manner.

The strap 36 is preferably preformed to have opposed legs 37 and 39 defined in part by a substantially reverse bend 50 having a radius of curvature R1 which may be about the same as or slightly less than the radius of curvature of the cylindrical cable sheath 40. The strap 36 is of sufficient length such that when the strap is assembled on the tubing string 22 in the position shown in FIG. 2 the distal end 48 may be drawn through the slot 46 in the buckle 42, the buckle crimped at 45 to secure the strap to the buckle and the excess portion of the strap including the distal end 48 severed directly adjacent the buckle at 49, for example. Moreover, the length of the leg 37, defined by the distance between the bend 50 and the buckle 42, is preferably predetermined so that the buckle is positioned as shown in FIG. 2 when the device 34 is secured to the tubing 24 and the cable 20.

Referring further to FIGS. 2 and 3, the insulator 38 is preferably characterized as an elastomeric body having opposed converging sidewalls 52 and 54, a first concave arcuate end wall 56 and an opposed concave arcuate end wall 58. A radius of curvature R2 of the end wall 56, FIG. 3, is preferably slightly greater than the radius of curvature of the sheath 40, and the radius of curvature R3, FIG. 3, of the end wall 58 is preferably about the same as or slightly greater than the radius of curvature of the tubing 24. Precise correlation of the radii R2 and R3 with the radii of curvature of the sheath 40 or the tubing 22 is not required since some elastic deformation of the insulator 38 is usually carried out in securing the insulator and the support strap 36 in accordance with the method of the invention. The insulator 38 includes opposed, generally parallel top and bottom surfaces 60 and 62, as shown in FIG. 3. The insulator 38 also includes an elongated slot 64 extending generally parallel to the sidewall 52 between the end walls 56 and 58. An elongated slit 66 intersects the slot 64 and the sidewall 52 approximately between opposite sides of the slot 64 to define opposed reentrant wall portions 53 and 55. The slot 64 is also, preferably, centered between the top and bottom surfaces 60 and 62.

The opposite sidewall 54 has an elongated generally rectangular-shaped channel 68 formed therein extending generally parallel to the sidewall 54 and being of a width slightly greater than the width of the strap 36. In like manner, the width of the slot 64 is slighter greater than the width of the strap 36. As shown in FIG. 3 the slot 64 is operable to receive the strap 36 and the strap 36 is also operable to be disposed in the channel 68 when the support device 34 is secured in its working position shown in FIG. 2. Accordingly, as shown in FIG. 2, the insulator 38 is adapted to be forcibly deformed into the position shown between the tubing 24, the sheathed power cable 20 and opposite sides of the strap 36 when it is secured as illustrated. Moreover, the insulator 38 provides for standing the cable 20 off a moderate distance from the tubing string 22 to substantially eliminate conductive heat transfer and to minimize convective and radiative heat transfer from the tubing string to the cable. The insulator 38 is preferably formed of a suitable elastomeric material, such as a nitrile rubber, having a Shore hardness of about 80 to 90.

Figure 4:
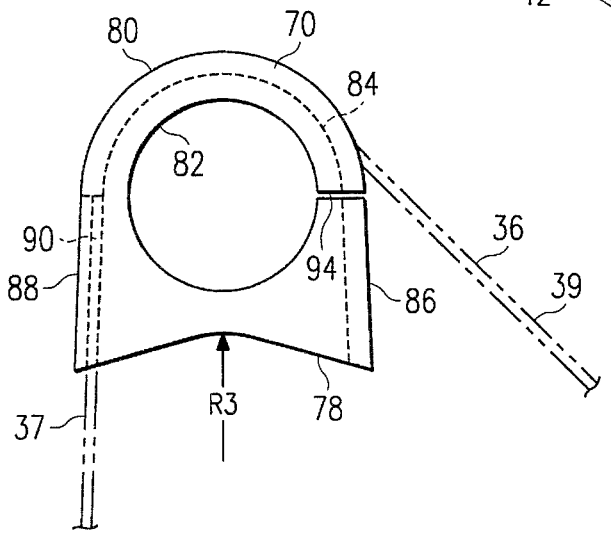
FIG. 4 is a plan view of an alternate embodiment of an insulator in a accordance with the invention.
Figure 5:
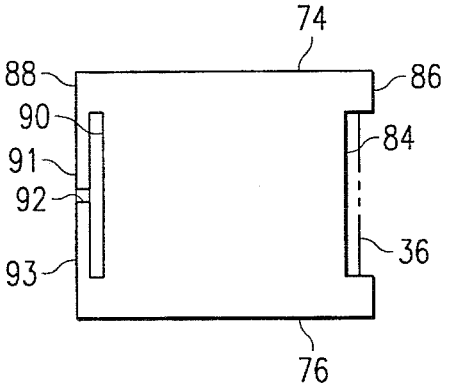
FIG. 5 is a side elevation of the insulator shown in FIG. 4.

Referring briefly to FIGS. 4 and 5, an alternate embodiment of an insulator in accordance with the invention is illustrated and generally designated by the numeral 70. The insulator 70 is preferably made of the same material as the insulator 38 but is characterized by a body 72 having opposed, generally parallel top and bottom walls 74 and 76, an arcuate concave end wall 78 having a radius of curvature R3 and an arcuate convex end wall 80. A generally cylindrical bore 82 extends between the top and bottom wall 74 and 76 and is of a diameter slightly greater than the diameter of the cable sheath 40. An elongated generally rectangular channel 84 extends along the periphery of the body 72 including a sidewall 86 and from the end wall 78 around the end wall 80 to a sidewall 88 where the channel 84 is contiguous with a slot 90 extending from the other side of the end wall 78 to the channel 84. The slot 90 is intersected by a slit 92, having generally the same configuration as the corresponding slot 64 and slit 66 for the insulator 38, and defining reentrant wall portions 91 and 93. The bore 82 is also intersected by a slit 94, FIG. 4, intersecting the sidewall 86 at its junction with the end wall 80.

The insulator 70 may be useful in certain installations where the power cable is not provided with a protective sheath and thus the arcuate end wall 80 and the remainder of the body 72 defining the bore 82 provides greater support for the cable and minimizes any tenancy to crush the cable when the strap 36 is tightened around the tubing and the cable in a manner to be described herein in conjunction with installation of the strap 36 and the insulator 38. Moreover, the insulator 70 provides for electrically insulating the cable sheath 40 from the tubing string 22. The strap 36 may be secured to the insulator 70 in substantially the same manner as shown for the support device 34, that is, the strap 36 may be trained through the slot 90 around the end wall 80 and be at least partially disposed within the channel 84.

Figure 6:
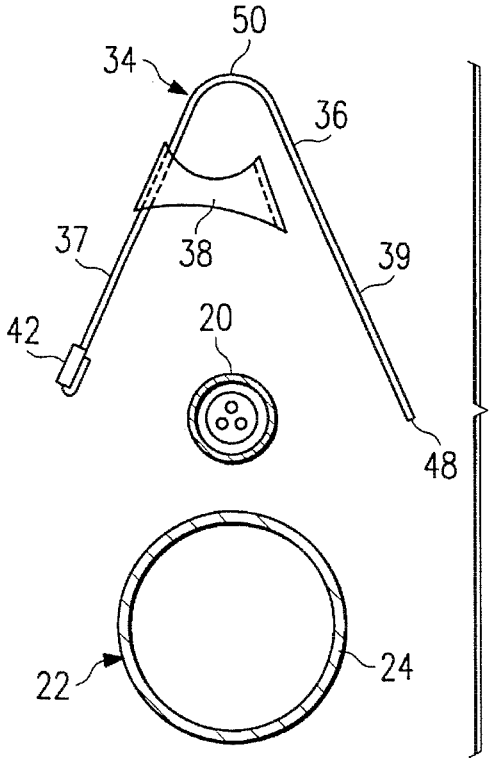
FIGS. 6 through are views taken generally in the same plane as the view of FIG. 2 showing certain steps in the method of attaching the insulator and support strap in accordance with the present invention.
Figure 8:
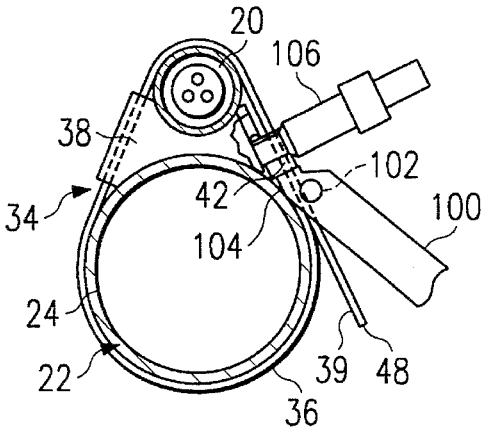
Figure 7:
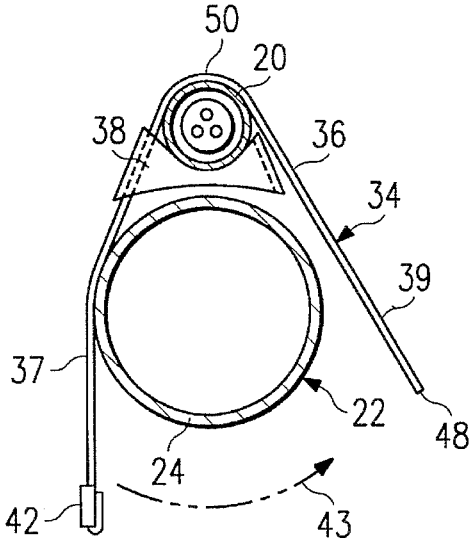

Referring now to FIGS. 6 through 9, a preferred method for installing the unique support device 34 for supporting the power cable 20 with respect to tubing string 22 is shown in certain sequential steps in FIGS. 6, 7 and 8. Prior to installing the support devices 34 a plurality of the support devices are preferably made up by inserting straps 36 through the slots 64 of the insulators 38 by threading the insulator over the distal end 48 and positioning the insulator, generally as shown in FIGS. 3 and 6 on the leg 37 of the strap 36. The strap 36 is preferably prebent to form the curved end portion 50 either before or after installing the insulator 38 thereon. Alternatively, one or both of the re-entrant wall portions 53 or 55, partially defining the slot 64, may be elastically folded back to allow insertion of the strap 36 laterally into the slot 64. In any event the insulator 38 is supported along one side on the strap 36.

The tubing string 22, in assembly with the pump 14, together with the power cable 20 is commenced to be lowered into the well 10 through the bushing 32 using conventional pipe handling equipment, not shown, on the rig 26. The support devices 34 are preferably spaced a suitable distance apart along the tubing string 22, normally about two to three feet, and the support devices are sequentially added to the tubing string 22, as it is being lowered through the bush 32, by operators on the deck 30. A support device 34 is initially positioned generally in the position shown in FIG. 6 with an insulator 38 attached to the strap 36 as shown. The support device 34 may then be moved into the position shown in FIG. 7 wherein the insulator 38 is disposed between the cable 20 and the tubing string 22 and the buckle 42 is in a position to be folded around the tubing string, generally in the direction of the arrow 43 in FIG. 7. Thanks to the assembly arrangement of the strap 36 supporting only one side of the insulator 38, the insulator may be easily moved into the position shown in FIG. 7 between the cable 20 and the tubing string 22.

The distal end 48 of the strap 36 is then inserted through the buckle 42 and pulled tight, thereby plastically bending the strap 36 around the tubing 24. Once the distal end 48 of the strap leg 39 is pulled through the buckle 42, a conventional power operated strapping tool may be applied to the support device 34 to tighten the strap 36 around the tubing 24 and the cable 20 with the insulator 38 disposed therebetween.

Figure 9:
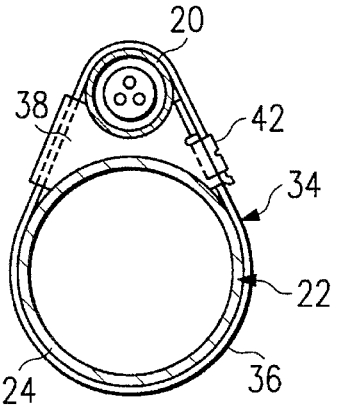

FIG. 8 illustrates a commercially available strapping tool 100 positioned to engage the leg 39 of the strap 36 by a motor-operated roller 102. The strapping tool 100 includes a support member 104 which is engageable with the buckle 42 while the roller 102 operates to tighten the strap 36 by drawing the leg 39 through the buckle and creating relative movement between the strap leg 39 and the buckle until a predetermined tension in the strap 36 is reached. Then, a commercially available crimping tool 106, FIG. 8, is applied to the buckle 42, generally as shown, and the buckle 42 is crimped at 45, FIG. 2, to secure the strap leg 39 to the buckle under a predetermined tension in the strap. The tools 100 and 106 are then removed from the device 34 whereby the operation is completed and the cable 20 is securely supported by the tubing string 22, as shown in FIG. 9. After completion of the crimping operation on the buckle 42 the strapping tool 100 may be pivoted back and forth to break off the excess length of the strap leg 39 which extends beyond the buckle 42 to the distal end 48 of the strap.

The aforementioned steps of tightening the strap 36 with the strapping tool 100 and crimping the buckle 42 with the tool 106 are believed to be within the purview of one skilled in the art as these tools are commercially available. One source of the tools 100 and 106 is the Signode Corporation, Glenview, Ill. Moreover, the final steps of the application of the support device 34 to the tubing string 22, which consist of operation of the tools 100 and 106, are generally known to those skilled in the art. The tubing string 22 is then lowered into the well 10 an additional distance sufficient to position the tubing string for attachment of the next support device 34 to the tubing string with its insulator 38 interposed between the power cable 20 and the tubing string. This operation is repeated until a desired number of support devices 34 are connected to the tubing string 22 and the tubing string and the pump 14 are lowered into the working position of the pump. When it is desired to remove a support device 34 from tubing string 22 in supportive relationship to a cable 20, a conventional strap cutting tool may be applied to the strap 36 to sever same in a known manner.

The method of assembling a support device which includes the strap 36 and the insulator 70 is similar in some respects to the aforedescribed method for assembling the device 34 to a tubing string 22 and power cable 20. A support device may be made up using the insulator 70 and a strap 36 by threading the strap through the slot 90 and folding the strap around the curved end wall 80 of the insulator until legs 37 and 39 of the strap are generally in the positions shown in FIG. 4. The re-entrant wall portions 91 and/or 93 may be folded back to insert the strap 36 into the slot 90 in the same alternative manner described above for inserting the strap into the slot 64 of the insulator 38. With a support device which includes the insulator 70 and a strap 36 assembled to each other, the insulator 70 may be deflected to increase the width of the slit 94 substantially to about that of the diameter of the cable 20 and the cable then inserted in the bore 82 whereby the elastic memory of the insulator 70 will allow it to close over the cable. Alternatively, the insulators 70 could be slipped around the power cable 20 by deflecting the insulators to increase the width of slits 94 sufficiently to accomplish this and in sufficient number, prior to insertion of the straps 36 through the slots 90 and bending the straps around the convex end walls 80. A support device including the strap 36 and the insulator 70 would then be tightened and secured to the tubing string and the power cable 20 essentially in the same manner described above for the support device 34.

The construction and method of installation of the unique standoff insulators 38 and 70 of the present invention and the unique method of supporting a power cable in a standoff, thermally insulated position relative to a fluid conducting tubing in accordance with the invention is believed to be understandable to those of ordinary skill in the art from the foregoing description. Although preferred embodiments of the invention have been described in detail herein, those skilled in the art will also appreciate that various substitutions and modifications may be made to the support device 34, the standoff insulators 38 and 70 and a method of attachment of the insulators to a power cable and tubing string may be carried out without departing from the scope and spirit of the invention as recited in the appended claims.

What is claimed is:

1. For use in a fluid production well including a tubing string connected to an electric submersible pump, said pump being operable to receive electric power transmission through an elongated power cable, a standoff insulator and support device for supporting said power cable at one or more predetermined positions along said tubing string, said support device including:

a flexible strap adapted to be trained around said power cable and said tubing string and tensioned to secure said power cable to said tubing string; and a thermal insulator adapted to be disposed between said power cable and said tubing string and between opposed legs of said strap for holding said power cable in a standoff position with respect of said tubing string to minimize heat transfer between said tubing string and said power cable.

2. The invention set forth in claim 1 wherein:

said insulator comprises a body formed of an elastomeric material.

3. The invention set forth in claim 2 wherein:

said body is formed of nitrile rubber.

4. The invention set forth in claim 1 wherein:

said insulator includes opposed sidewalls, at least one of said sidewalls defining a slot for receiving a leg of said strap for supporting said insulator on said strap.

5. The invention set forth in claim 4 wherein:

the other of said sidewalls includes means forming a channel for receiving said strap when said strap is tensioned to secure said insulator between said power cable and said tubing string.

6. The invention set forth in claim 4 wherein:

said slot is delimited by opposed re-entrant wall portions engageable with said strap to retain said strap in said slot, said wall portions being elastically deflectable to provide for one of inserting and removing said strap with respect to said slot.

7. The invention set forth in claim 4 wherein:

said insulator includes opposed concave end walls for engagement with said power cable and said tubing string, respectively.

8. The invention set forth in claim 7 wherein:

said insulator includes an end wall and a bore formed in said insulator for receiving said power cable.

9. The invention set forth in claim 8 wherein:

said insulator includes a slit intersecting said bore and one of a sidewall and said end wall for providing deflection of said insulator to place said insulator disposed around said power cable with said power cable extending through said bore.

10. A method of supporting a power cable in a standoff thermally insulated position from a tubing string in a submersible pump well installation, said method comprising the steps of:

providing a device comprising a flexible strap and an insulator body, said insulator body being adapted to be interposed between said power cable and said tubing string for holding said power cable in a standoff insulated position from said tubing string when said strap is trained around said power cable and said tubing string and tensioned to secure said power cable to said tubing string;

placing said insulator body between said tubing string and said power cable;

wrapping said strap around said tubing string and said power cable;

tensioning said strap to engage said power cable and said tubing string with said insulator body; and securing said strap.

11. The method set forth in claim 10 including the step of:

attaching said insulator body to a leg of said strap along one side of said insulator body prior to wrapping said strap around said power cable and said tubing string.

12. The method set forth in claim 10 including the step of:

inserting a distal end of said strap through a slot in said insulator body and placing said insulator body between a buckle on said strap and a part of said strap defining opposed legs of said strap prior to placing said strap around said power cable and said tubing string.

13. The method set forth in claim 10 including the step of:

providing said strap with a preformed bend therein for receiving said power cable.

* * * * *